US005746633A

United States Patent [19]

Jeffrey

[11] Patent Number: 5,746,633

[45] Date of Patent: May 5, 1998

[54] PERSONAL FLOTATION DEVICE

[76] Inventor: Lawrence W. Jeffrey, 842 E. Alosta, Sp. #18, Glendora, Calif. 91740

[21] Appl. No.: 744,622

[22] Filed: Nov. 6, 1996

Related U.S. Application Data

[63] Continuation-in-part of Ser. No. 589,811, Jan. 22, 1996, abandoned.

[51] Int. Cl.[6] ..... B63C 9/15

[52] U.S. Cl. ..... 441/123; 441/97

[58] Field of Search ..... 441/23, 97, 95, 441/106, 108, 111, 116, 118, 123, 112

[56] References Cited

U.S. PATENT DOCUMENTS

| | | | |
|---|---|---|---|
| 1,252,842 | 1/1918 | Richardson | 441/116 |
| 1,367,225 | 2/1921 | Barker | 441/95 |
| 1,442,746 | 1/1923 | Timberlake | 441/123 |
| 2,742,654 | 4/1956 | Hurt | 441/123 |
| 2,894,658 | 7/1959 | Spidy | 441/95 |
| 3,308,494 | 3/1967 | Licher | 441/97 |
| 3,952,355 | 4/1976 | Bardebes | 441/92 |
| 4,379,705 | 4/1983 | Saotome | 441/94 |
| 4,540,370 | 9/1985 | Hebert | 441/23 |
| 5,295,765 | 3/1994 | Choi | 441/106 |

*Primary Examiner*—Sherman Basinger
*Attorney, Agent, or Firm*—Boniard I. Brown

[57] ABSTRACT

An inflatable personal flotation device for positioning at the shoulders of a user has front and rear float portions, automatic inflating apparatus for operation upon immersion in water, a harness comprising a belt disposed about the user, at least one shoulder strap between the belt and the float, and elastic straps between the harness and the float front and rear portions to urge downwardly thereon on the float portions in response to the weight of a user urging downwardly the central portion of the float. Hinges are preferably provided between the front and rear float portions for improved bendability therebetween. A chin strap may be provided for the user's head when the float is inflated.

25 Claims, 3 Drawing Sheets

PERSONAL FLOTATION DEVICE

RELATED APPLICATIONS

This application is a continuation-in-part of application Ser. No. 08/589,811, filed Jan. 22, 1996, entitled "Flotation Device" and now abandoned.

BACKGROUND OF THE INVENTION

1. Field of the Invention

The present invention relates to personal flotation devices and, more particularly, to automatically inflating flotation devices adapted to be worn at the shoulders of a child or other user.

2. Prior Art

Flotation devices have long been used for providing buoyancy for a person in the water. Flotation devices have been inflatable by a person's breath, or by pump means. Personal flotation devices are utilized for users, or particularly children, to prevent accidental drownings in swimming pools or other bodies of water, and as swimming aids. Many such flotation devices are bulky and not easily worn by the user.

Pat. No. 1,252,842 to Richardson relates to a life preserver attached about the neck, chest and back of a user by a strap arrangement. Pat. No. 3,308,494 to Licher relates to an inflatable life preserver having two portions disposable about the neck of a user, and having an automatic inflator device producing pressurized gas to inflate the life preserver. Pat. No. 4,379,705 to Saotome relates to a life belt with a tubular body and a compressed gas capsule for inflation. Pat. No. 3,952,355 to Bardebes discloses an inflatable buoyancy aid including an elongate inflatable member, gas-producing means for inflation, and securing means for fastening the buoyancy aid about the trunk of a user.

There has existed a need for a personal flotation device for children or other users which is automatically inflatable and has means for maintaining the user's head above water, including strap means for urging downwardly portions of the float in accordance with the level to which the user's body is immersed, thus to provide buoyancy in accordance with the weight of a user for urging float portions downwardly for proper buoyancy.

SUMMARY OF THE INVENTION

The present invention relates generally to personal flotation devices, and particularly to flotation devices adapted for positioning at the shoulders or about the neck of a user, and having front and rear float portions. A harness connected with the float comprises a belt to be disposed about the user, at least one shoulder strap extending between the belt and float, and elastic straps between the harness and the float. The elastic straps preferably comprise a plurality of elastic straps connected with the belt and with the front and rear float portions. With the float inflated, the elastic straps pull downwardly on the front and rear portions in response to the weight of the user urging downwardly the central portion of the float urging upwardly the front and rear float portions.

The harness preferably includes an elongated strap extending between the legs of the user and preventing upward movement of the harness relative to the user. The belt and the elongated strap may preferably have ends terminating in buckle portions for adjustable securement of the belt and the elongated strap.

Hinge means are provided between the front and rear float portions for improved bendability therebetween in response to forces on the front and rear float portions.

An automatic inflation device is provided on the device for automatic production of float inflating pressure upon immersion in water.

DESCRIPTION OF PREFERRED EMBODIMENT

Figure 4:
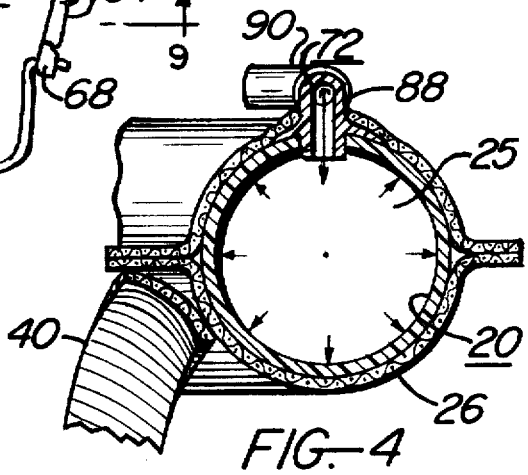
FIG. 4 is an enlarged sectional view taken at line 4—4 in FIG. 1.
Figure 5:
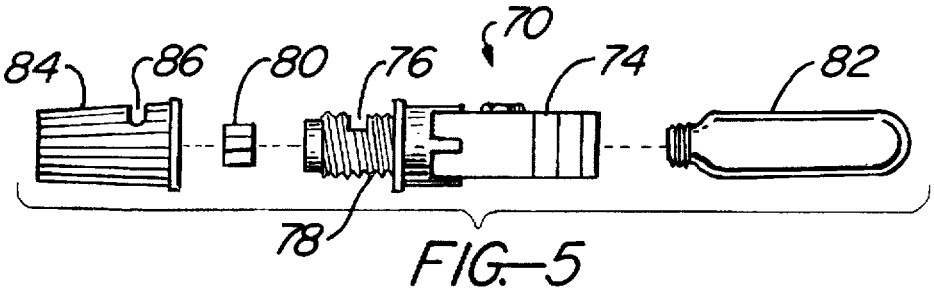
FIG. 5 is an exploded view showing components of an automatic inflation device.
Figure 6:
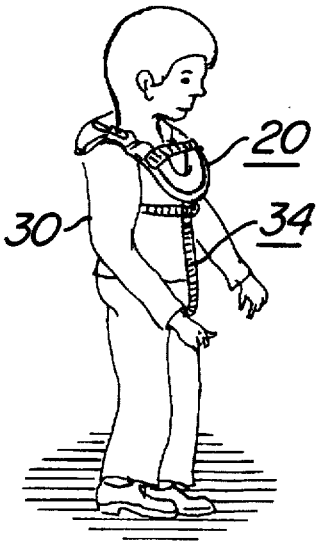
FIG. 6 is a perspective view showing a child wearing the flotation device of FIGS. 1 and 2 in a deflated state.
Figure 7:
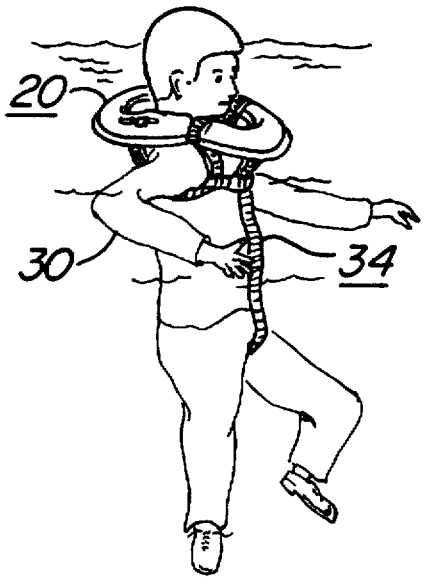
FIG. 7 is a perspective view of a child wearing the flotation device of FIGS. 1 and 2 in its inflated state and in water.
Figure 10:
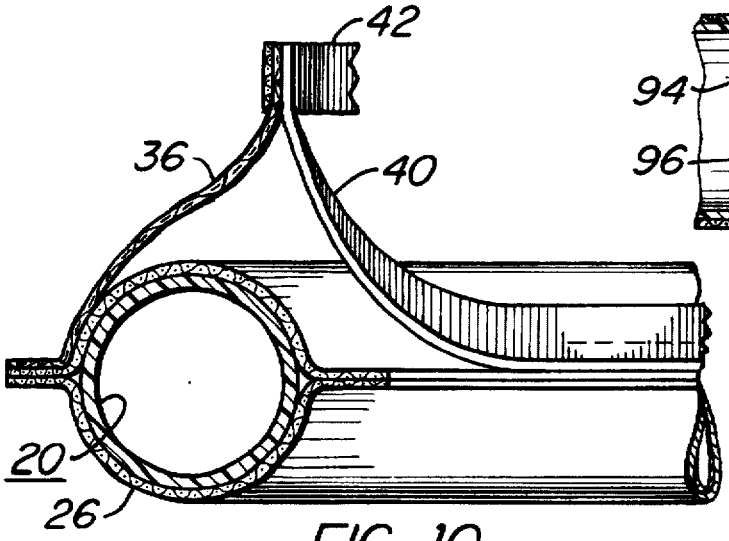
FIG. 10 is a partial sectional view taken at line 10—10 in FIG. 9.

Referring to the drawings, a flotation device 10 has a float 20 of generally tubular configuration, having a front portion 22 and rear portion 24. Tubular float member 20 includes an interior chamber containing an amount of air or gas to inflate the float. A cover 26 may be positioned on the tubular float 20 (FIGS. 4 and 10) and attached by appropriate means such as snaps or stitching (not shown). The tubular float may be formed of nylon coated with urethane or other suitable waterproof material. Cover 26 may be formed of any suitable material, such as nylon or cotton, and may bear appropriate designs for child users, such as cartoon characters, bears, or other appealing designs. Tubular float 20 has defined therein a seam 28 on each of the opposite sides of the float and between the front and rear portions 22 and 24, which serve as hinges to enable effective bending of the tubular float at the seams. On one side the seam comprises two portions which define a passage for purposes hereinafter mentioned. The seams may be formed by heat sealing or other appropriate means.

The overall flotation device includes a harness 34, shoulder straps 40, a belt 42, and an elongated lower strap 44. The shoulder straps are attached to the tubular float 20 and extend about the shoulders of the person or child. The shoulder straps are secured by any suitable means such as by sewing or adhesive, for maintaining the position of the float 20 in relation to the neck of the child or user. Each shoulder strap has a first end portion attached at one position on a belt strap and a second end portion 48 attached at a second position on the belt strap, as shown.

The belt strap 42 extends about the torso or chest of the user 30 and has a first end 50 and a second end 52. The first and second ends 50 and 52 terminate in mating buckle portions 54 and 56, respectively. The male buckle portion 56 can be quickly and easily snapped into and released therefrom a female buckle portion 54. An adjusting member 58 may also be provided on one of the strap portions, such as portion 54, for quickly and easily adjusting the overall length of the first and second ends 50 and 52 for securing the belt strap 42 about the person 30. Alternatively, the first and second ends 50 and 52 may be one integral piece stitched or otherwise fastened together.

The elongated strap 44 has a first end portion 60 and a second end portion 62. The elongated strap 44 is positioned between the legs of the person 30 for retaining the harness downwardly on the user 30 and for preventing the user 30 from slipping through the float 20. The first end portion 60 is attached to the belt strap 42 at a location between the attachment of the first ends of the shoulder straps 40, and the second end portion 62 is attached to the belt strap 42 at a location between the attachment of the second ends of the shoulder straps 40. The elongated strap 44 extends from the belt strap 42 in a direction opposite to the extension of the shoulder straps 40 from the belt strap 42.

The first and second end portions 60 and 62 of the elongated strap 44 terminate in mating buckle portions 64 and 66, respectively. The male buckle portion 66 can be quickly and easily snapped into and released therefrom a female buckle portion 64. An adjusting member 68 may also be provided on one of the strap portions, such as portion 64, for quickly and easily adjusting the overall length of the portions 60 and 62. Alternatively, the first and second end portions 60 and 62 may be one integral piece stitched or otherwise fastened to the belt strap 42.

Preferably, the buckle portions 54 and 56 of the belt strap 42 and the buckle portions 64 and 66 of the elongated strap 44 are positioned to the rear of the user 30, such as a child, so that the child cannot reach them.

Figure 3:
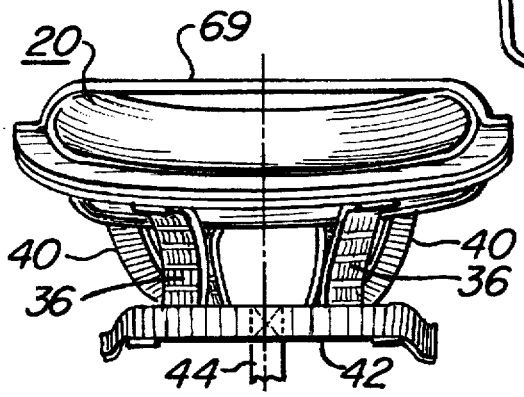
FIG. 3 is a frontal view taken at line 3—3 of FIG. 2.

A chin strap 69 (FIGS. 1 and 3) is attached at opposite sides of the float, as by adhesive or stitching, and extends across the central opening to support the head of a user when the float is inflated.

Referring to FIGS. 1, 2, 4 and 5, the flotation device 10 further includes an inflation mechanism or device, such as an automatic inflator device 70 and a manual inflator device 72. Preferably, automatic and manual inflator devices 70 and 72 are attached to the tubular member 20 at a position which is to the rear of the person 30, such as a child, so that the child cannot reach them. An advantage of the flotation device 10 is that the tubular member 20 is automatically inflated by immersion in water, which is very desirable when the user is a child. The flotation device 10 can therefore be worn deflated by the person or child. For a small child, a deflated device is more comfortable to wear, as compared to a bulky inflated device, making it more likely that the child can be required to wear and will wear the flotation device 10.

Figure 9:
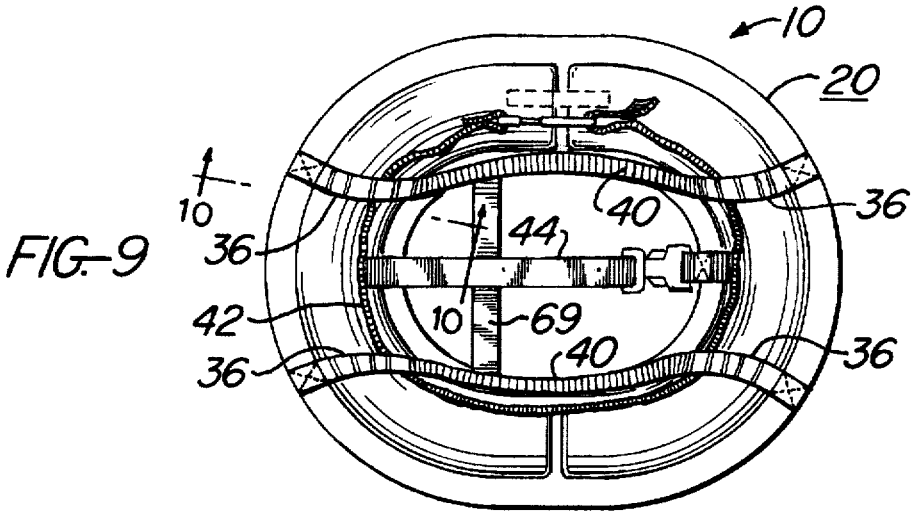
FIG. 9 is a view taken at line 9—9 in FIGS. 2 and 8.

Elastic straps 36 are attached to the belt 42 or, alternatively, to the portions of shoulder strap 40 adjacent to the belt (FIGS. 9 and 10), and are attached to the float 20. Preferably, two elastic straps 36 are attached at the front of the float 10 and two elastic straps are attached at the rear of the float 10, each having its other end attached to the belt 42. The elastic straps may be attached to the float 20, or to cover 26, by suitable means, as by sewing or by adhesive.

Alternatively, elastic straps 36 and shoulder straps 40 may be integrally formed (not shown) or the shoulder straps and elastic straps could be integrated together (not shown), or the ends of the belt and the second end portions 60, 62 of the elongated strap 44 could be integrally formed (not shown).

The elastic straps 36 are dimensioned and adapted to be stretched between the belt 42 and the front and rear portions of the float, when in the water, to urge downwardly the front and rear portions against the buoyancy of the float and the upward urging on the front and rear portions by the weight of the user or child pulling down on the center portion of the float.

Figure 2:
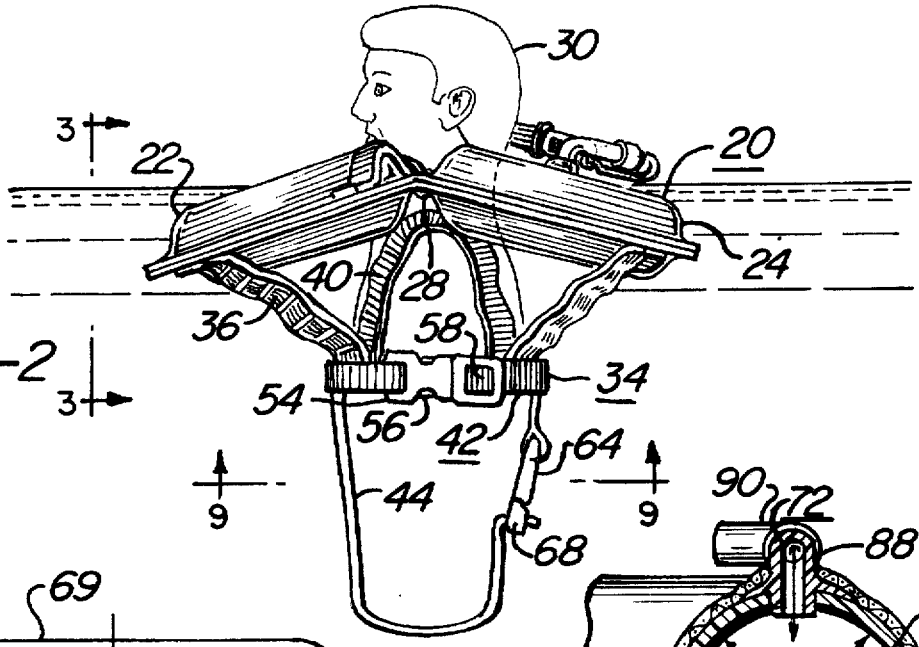
FIG. 2 is an elevational view of the flotation device of FIG. 1 disposed about the neck and shoulders of a user.
Figure 8:
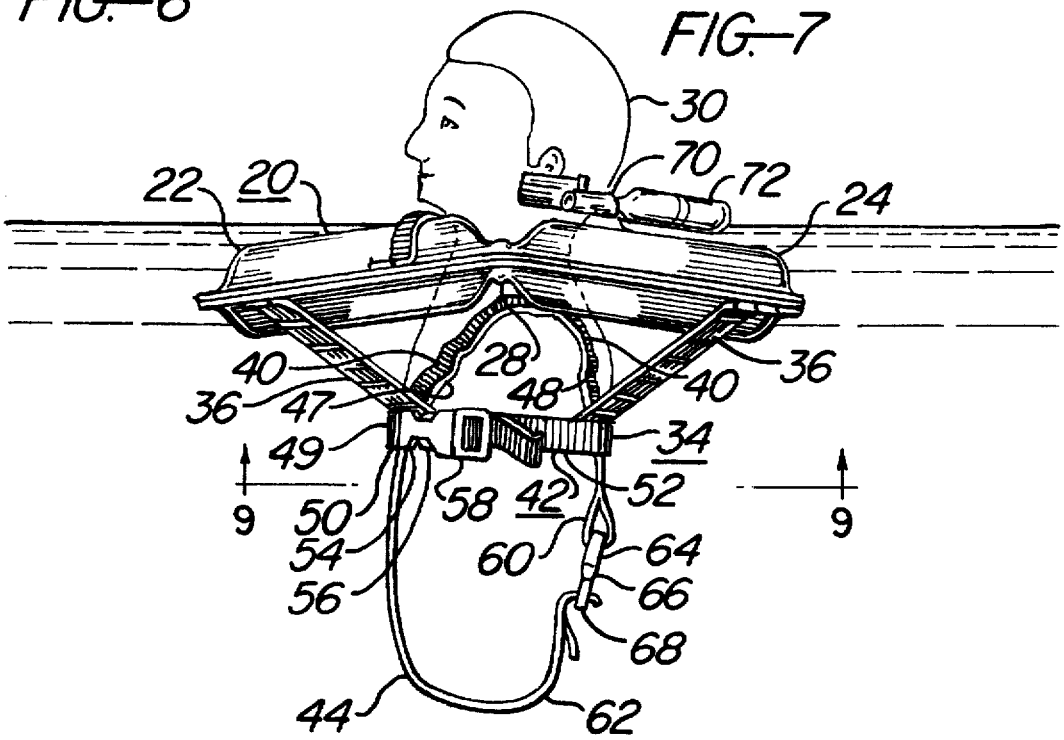
FIG. 8 is a view similar to that of FIG. 2 showing the flotation device operating to exert downward force on float end portions.

The hinge seams 28 enable the float front and rear portions to bend readily relative to each other, to provide increased buoyancy to maintain the user's head above water. With the float and user in the water, the front and rear portions 22, 24 can tilt downwardly and be positioned to a depth in the water greater than otherwise would be provided. Improved or additional buoyancy is provided to the child or other user, and serves to maintain the head above water and maintain the float away from the user's face. The hinge seams 28 and elastic straps 36 maintain the float away from the user's face and maintain the child's or user's head above the float and the water level. A small child of, say, 11–18 months of age, or so, lacks sufficient control, judgment and ability to support itself in the water and it is important that the child's head be maintained above water level. With a relatively heavy child or user in the water, the weight of the child pulls down on the center portion of the float more than a lighter child would pull down, thus urging the front and rear portions of the float upwardly. The heavier the child, the greater this downward pull on the central portion of the float, the child's head thus being urged lower relative to the water level (FIG. 8). With a lighter child, the end portions of the float are relatively deeper in the water than with a heavier child, because the child's weight does not cause the head and central part of the float to be lower in the water, so that the front and rear portions of the float are normally tilted downwardly (FIG. 2). That is, a lighter child has his shoulders and head more out of the water.

With the heavier child, the elastic straps 36 thus pull downwardly on the front and rear portions of the float, retaining at least the major portions of the front and rear portions submerged, thus providing increased and improved flotation in accordance with the weight of the child. It will be understood that the harness, including belt 42, remains essentially fixed in position when properly placed on a child or user, the belt 42 being secured and the elongated strap 44 between the legs holding down the harness.

The automatic inflator device 70 includes an inflator body 74 having a water passage 76 and a threaded portion 78. An inflator pellet 80 of a material which reacts with water to produce $CO_2$, such as sodium, is positioned within the body 74. Preferably, the inflator pellet can only be installed one way with the inflator body 74, as by aligning grooves with tabs of the inflator body 74. The device 70 further includes a $CO_2$ cartridge 82, which is screwed into the inflator body 74. An inflator cap 84 has inside diameter threads which mate with the threaded portion 78 of the inflator body 74 for securing together the components of the inflator device 70. The inflator cap 84 has a water passage 86 aligned with the water passage 76 of the inflator body when the components of the automatic inflator device 70 are assembled for providing fluid communication of the water with the inflator pellet 80. Tightening of the components of the inflator device 70, as by screwing together the cap 84 and the inflator body 74, enables the pellet 80 to cock the firing pin, which is positioned within the inflator body 74.

In utilizing the flotation device, if a child or other user wearing the flotation device falls into the water, such as a swimming pool, or from a boat into the water, the sodium pellet will dissolve in approximately 2 to 5 seconds upon contacting the water and the pellet reacts with the water to produce $CO_2$ for inflating the tubular member 20 along with the $CO_2$ expelled from the cartridge 80.

Manual inflator device 72 includes a valve stem 88 and a one-way mouth or oral valve 90 in fluid communication with the interior of the tubular member 20. A person may blow air into the one-way mouth valve 90, after removing a cap 92 to inflate the tubular member 20. A valve core in the valve stem retains the air within the tubular member 20. Preferably, the valve stem 88 can be installed in the body of the inflator only one way due to the inflator having a circular opening with a flat side. For use of the flotation device 10 as a swimming aid, the automatic inflator device 70 can be removed and the manual inflator device 72 used to inflate the tubular member 20 of the flotation device 10 prior to entry into the water.

Figure 1:
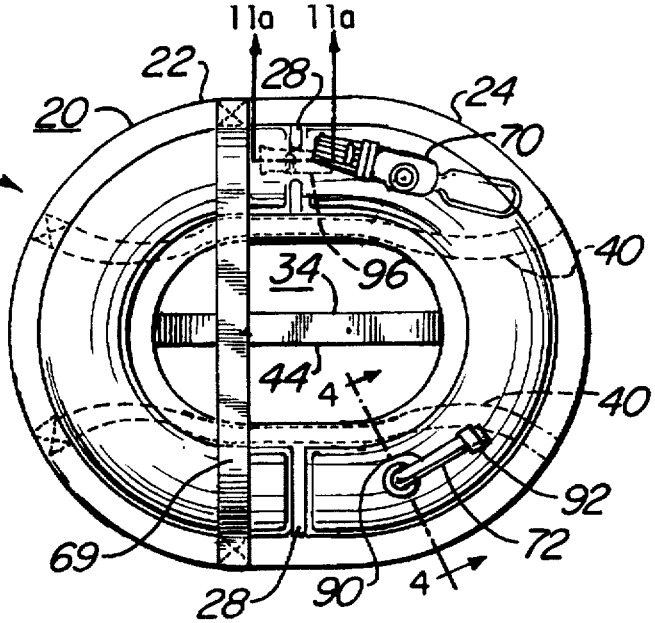
FIG. 1 is a plan view of a personal flotation device according to the present invention.
Figure 11A:
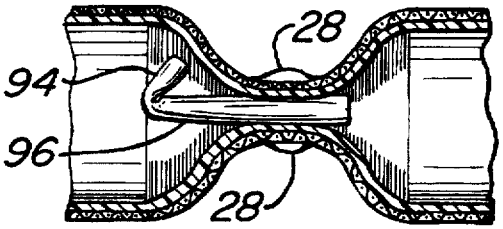
FIG. 11A is a view of the one-way valve within the flotation device.
Figure 11:
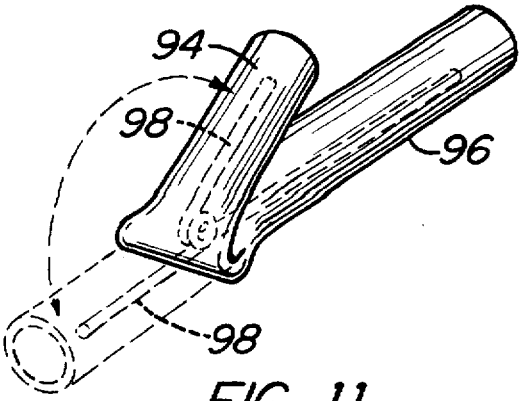
FIG. 11 is a perspective view of a one-way valve utilized with the float of the flotation device of the invention.
Figure 10A:
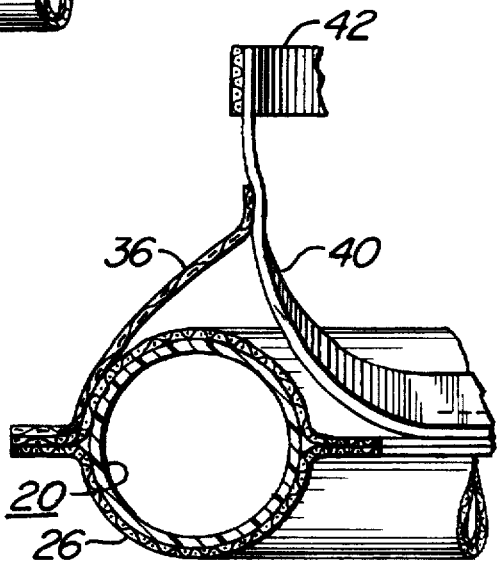
FIG. 10A is a view similar to that of FIG. 10 showing an alternate attachment of an elastic strap to the harness.

The spacing between the seams or welds 28 on one side of the float (upper portion of FIG. 1) defines a passage for pressurized gas between the front and rear portions of the float. A one-way valve 94 is positioned in this passage and is secured by appropriate means, such as adhesive securement. The automatic inflator device 70, immediately upon being submerged, injects pressurized $CO_2$ gas into the float. The pressurized gas is admitted to one portion of the float (FIG. 1). The one-way valve (FIGS. 1 and 11) is urged open to admit gas to the other float portion. The valve is formed of a flexible resilient material and is creased for folding to define a bent portion 96. A resilient spring wire element 98 is secured as by heat welding, longitudinally along the wall of the valve transversely of the crease. The gas pressure acts on the valve to urge it open by bending or unfurling the bent portion into its open configuration (shown in broken lines). Upon the pressure being equalized between the two float portions, the valve is closed by action of the spring wire to fold the bent portion to its closed configuration shown. Thus, if one portion should leak gas pressure, the other side can provide buoyancy.

Thus there has been shown and described a novel personal flotation device which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. An inflatable personal flotation device comprising:

a float for positioning at the shoulders of a user and having front and rear portions, means for inflating the float upon being disposed in water, harness means connected with the float and comprising a belt to be disposed about the user, at least one shoulder strap extending between the belt and the float, and elastic strap means between the harness and said float, and said elastic strap means comprising a plurality of elastic straps connected with the front and rear float portions to pull downwardly thereon when the float is inflated in response to the weight of the user urging downwardly the central portion of the float to urge the front and rear float portions upwardly.

2. A personal flotation device according to claim 1, wherein:

said elastic straps are connected with said belt and with the front and rear float portions.

3. A flotation device according to claim 2, wherein the plurality of the elastic straps comprises at least two elastic straps.

4. A flotation device according to claim 2, and further including:

an elongated strap connected with the belt and extending between the legs of the user to retain the harness against upward movement relative to the user.

5. A personal flotation device according to claim 4, wherein said elongated strap has first and second end portions with buckles thereon for adjustment of the strap about the user.

6. A flotation device according to claim 2, wherein said belt has end portions with mating buckle portions thereon for adjustment of the belt about the user.

7. A flotation device according to claim 2, and further including:

chin strap means extending across a central opening of the float when inflated to support the, user's head.

8. A flotation device according to claim 2, and further including:

hinge means between the front and rear float portions for improved bendability therebetween.

9. A flotation device according to claim 8, wherein said hinge means comprise seams defined between the front and rear portions on either side of a central opening of the float.

10. A personal flotation device according to claim 9, wherein:

one of said seams on one side of said float opening defines a passage therethrough for pressurized gas, and further including:

one-way valve means at said passage and adapted to open in response to pressure in one float portion to admit pressure to the other float portion, and to close to reduce pressure differential between the float portions.

11. A personal flotation device according to claim 10, when said one-way valve means has a bent flexible portion which unbends upon application of pressure at one end of the valve and is resiliently urged to a folded sealing position when the pressure differential across the valve is reduced.

12. A personal flotation device according to claim 2, and further including:

automatic inflation means having an automatic inflator for producing inflating pressure in the float upon immersion in water.

13. A flotation device according to claim 12, wherein said automatic inflator device includes a pellet to react with water to produce $CO_2$ gas.

14. A personal flotation device according to claim 2, and further including:

a manually operated inflation means on the flotation device for operation by the user.

15. A flotation device according to claim 1, and further including:

an elongated strap connected with the belt and extending between the legs of the user to retain the harness against upward movement relative to the user.

16. A personal flotation device according to claim 15, wherein said elongated strap has first and second end portions with buckles thereon for adjustment of the strap about the user.

17. A flotation device according to claim 1, wherein said belt has end portions with mating buckle portions thereon for adjustment of the belt about the user.

18. A flotation device according to claim 1, and further including:

chin strap means extending across a central opening of the float when inflated to support the user's head.

19. A flotation device according to claim 1, and further including:

hinge means between the front and rear float portions for improved bendability therebetween.

20. A flotation device according to claim 19, wherein said hinge means comprise seams defined between the front and rear portions on either side of a central opening of the float.

21. A personal flotation device according to claim 20, wherein:

one of said seams on one side of said float opening defines a passage therethrough for pressurized gas, and further including:

one-way valve means at said passage and adapted to open in response to pressure in one float portion to admit pressure to the other float portion, and to close to reduce pressure differential between the float portions.

22. A personal flotation device according to claim 21 when said one-way valve means has a bent flexible portion which unbends upon application of pressure at one end of the valve and is resiliently urged to a folded sealing position when the pressure differential across the valve is reduced.

23. A personal flotation device according to claim 1, and further including:

automatic inflation means having an automatic inflator for producing inflating pressure in the float upon immersion in water.

24. A flotation device according to claim 23, wherein said automatic inflator device includes a pellet to react with water to produce $CO_2$ gas.

25. A personal flotation device according to claim 1, and further including:

a manually operated inflation means on the flotation device for operation by the user.

* * * * *